US006439975B1

(12) United States Patent
Shih et al.

(10) Patent No.: US 6,439,975 B1
(45) Date of Patent: Aug. 27, 2002

(54) METHOD FOR FORMING CONTACT OF ELECTRICAL CONNECTOR AND PRESS DIE FOR PRACTICING THE METHOD

(75) Inventors: Tsang-Chien Shih; Kuo Ching Lee, both of Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/493,306

(22) Filed: Jan. 28, 2000

(51) Int. Cl.[7] ..... B24B 1/00

(52) U.S. Cl. ..... 451/57; 451/41; 451/40; 451/540; 451/908; 451/910

(58) Field of Search ..... 451/57, 60, 540, 451/908, 910

(56) References Cited

U.S. PATENT DOCUMENTS 3,707,932 A * 1/1973 Murray ..... 113/119
4,220,393 A * 9/1980 Ammon et al. ..... 439/682
4,255,003 A * 3/1981 Berg ..... 439/7
4,287,748 A * 9/1981 Wolfthal ..... 72/405
5,307,562 A * 5/1994 Denlinger et al. ..... 29/882
5,768,777 A * 6/1998 Lemke ..... 29/882

* cited by examiner

*Primary Examiner*—Joseph J. Hail, III
*Assistant Examiner*—Shantese McDonald
(74) *Attorney, Agent, or Firm*—Wei Te Chung

(57) ABSTRACT

A press die for forming a contact of an electrical connector by blanking a metal sheet is disclosed. The die has a die insert for shaving an engaging section of the contact for electrically engaging with a conductive portion of a device mating with the electrical connector so that an electrical connection between the connector and the device is created. A profile of the die insert for the shaving operation is subject to a final finishing process by an ultrasonic machining using a machining agent consisted of diamond particles dispersed in liquid, wherein the diamond particles have a grit size of 8000#. The profile of the die insert has a surface roughness of 0.08 Ra.

11 Claims, 5 Drawing Sheets

METHOD FOR FORMING CONTACT OF ELECTRICAL CONNECTOR AND PRESS DIE FOR PRACTICING THE METHOD

BACKGROUND OF THE INVENTION

1. Field of the Invention

The present invention is related to a method for forming contacts of an electrical connector, a press die for practicing the method, and an electrical contact obtained by the method.

2. Description of Prior Art

As the conditions of signal transmission between different electronic devices are getting severer and severer (for example, high speed and density transmission under heated and corrosive atmosphere), the quality of contacts of connectors for achieving an electrical connection between the devices is required to be higher and higher. To meet the requirement, dimension accuracy and surface quality of an engaging section of the contact for achieving the electrical connection seek endless improvement.

The contact, after a mechanical forming, is subject to an electrical plating process whereby a noble metal is coated to the engaging section of the contact to improve electrical conductivity and thus signal transmission quality of the contact. To form the engaging section with a required precise dimension and a smooth surface so that it can accurately and reliably engage with a conductive portion of a complementary device under certain conditions, i.e., sufficient normal force, low mating force, etc., and can be uniformly and firmly plated with the noble metal so that the coating can stand severe environment, i.e., corrosive and heated environment, the engaging section is usually subject to a shaving operation by a die insert of a press die for forming the contact.

Conventionally, a profile of the die insert for the shaving operation is subject to a profile grinding by using a diamond grinding wheel to have a surface of the profile with a roughness of about 0.12 Ra. The engaging section thus formed can meet the old use in which the required specifications for the contacts to meet are moderate. However, for the newly developed electronic devices, for example, a RIMM connector which is used for connecting a Rambus memory module to a mother board, the contacts formed by the conventional technology cannot meet the severer requirements. To shave the engaging section of the contact by the die insert processed by the conventional technology causes the engaging section not smooth enough so that the coating of the noble metal thereon is not sufficiently uniform and firm. A non-uniform coating of the noble metal on the engaging section causes the surface of the coating is not smooth enough so that a large mating force is needed when the complementary device is inserted into the connector. A large mating force may cause the engaging section to warp. A non-firm coating of the noble metal on the engaging section causes the noble metal to easily separate from the contact when the connector is under a heated/corrosive environment or when the contact is repeatedly engaged/disengaged with/from the complementary device.

Finally, when shaving the engaging section by the conventionally processed, relatively rough die insert, the engaging section can not obtain the required precise dimension whereby the required normal force should be exerted to the conductive portion of the complementary device by the engaging section may not be achieved, which in turn may deteriorate the signal transmission quality between the connector and the complementary device.

Hence, an improvement is needed to eliminate the above mentioned defects of prior art.

SUMMARY OF THE INVENTION

Accordingly, an objective of the present invention is to provide a press die for forming a contact of a connector, wherein a die insert of the press die for shaving a mating device engaging section of the contact has an extraordinarily smooth surface so that the mating device engaging section can have a corresponding smooth surface and precise dimension after the shaving process. The engaging section after the shaving process can be very uniformly and firmly coated with a layer of noble metal thereon by a electrical plating process.

A further objective of the present invention is to provide a method for forming a contact of an electrical connector by utilizing a press die having a die insert with an extraordinary smooth surface on a portion thereof for conducting a shaving operation to an engaging section of the contact. Thus, the engaging section of the contact for electrically engaging with a conductive portion of a complementary device can have an extraordinary precise dimension and smooth surface. A noble metal layer can be firmly and evenly coated to the engaging section of the contact formed in accordance with the method.

A still further objective of the present invention is to provide a contact which can meet the severer requirements for the newly developed electrical connector such as RIMM connectors for connecting newly developed electronic devices, for example, Rambus memory modules to mother boards.

To achieve the above objectives, a profile of a die insert for shaving an engaging section of a contact of an electrical connector during a mechanical forming of the contact by blanking a metal sheet is subject to a final finishing process by an ultrasonic machining after a profile grinding process. The ultrasonic machining consists of several successive steps using diamond particles dispersed in liquid as the working agent, wherein the diamond particles have the following correspondingly different grit sizes in the different steps: $600^{\#}$, $1000^{\#}$, $2000^{\#}$, $5000^{\#}$, and finally $8000^{\#}$.

DETAILED DESCRIPTION OF THE PREFERRED EMBODIMENT

Reference will now be made in detail to the preferred embodiment of the present invention.

In FIGS. 1–4, in order to distinguish the die blocks and inserts in different working stations, the die blocks and inserts in different working stations are expressed in different hatch lines. These hatch lines are not used to indicate that the die blocks and inserts are made of different materials. They are all made of tool steel. Furthermore, although all contacts are shown completely formed in these drawings and the blanking steps are not successively performed, they are so shown for the convenience to create the drawings. Persons skilled in the art can fully understand that the contacts will be completely formed only when a corresponding part the metal sheet has been thoroughly undergone these blanking steps, and these blanking steps are successively performed to the corresponding part of the metal sheet.

Figure 1:
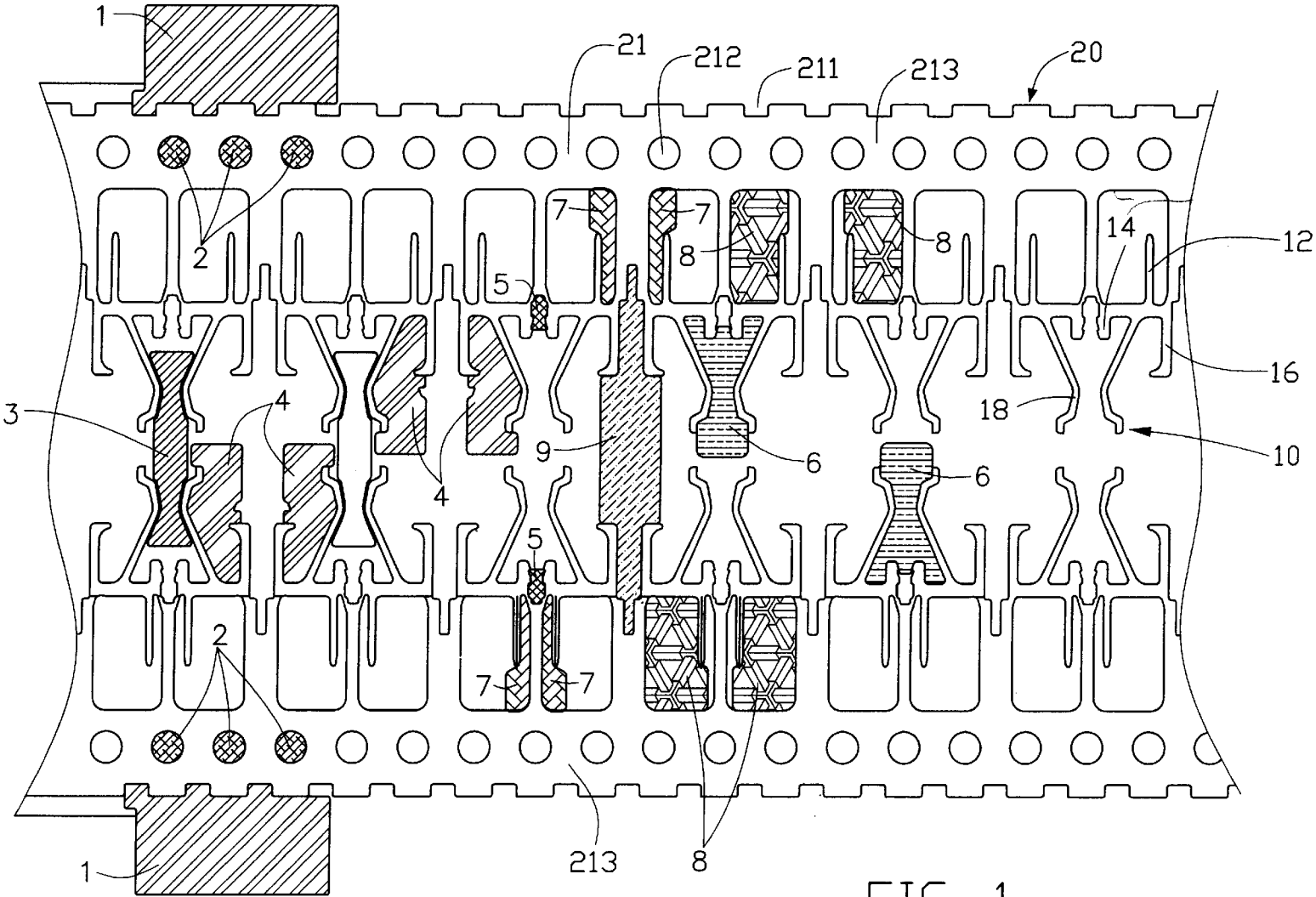
FIG. 1 is a plane view of a contact strip showing that a contact of an electrical connector is formed by blanking a metal sheet with a number of working steps.
Figure 2:
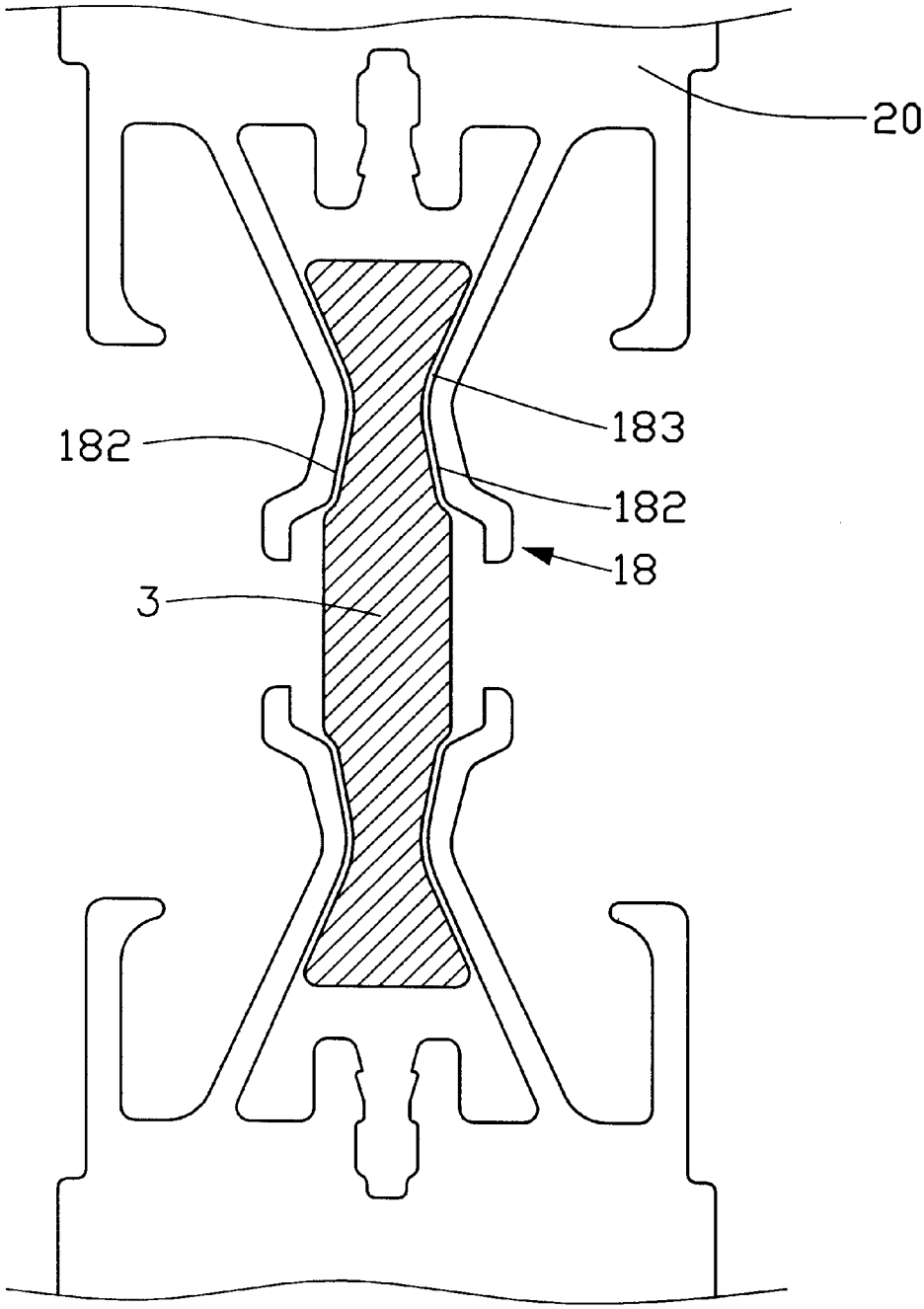
FIG. 2 is an enlarged plane view showing that engaging sections of the contact is blanked by an upper die block, wherein material is left beside the engaging sections for being subject to a latter shaving operation.
Figure 3:
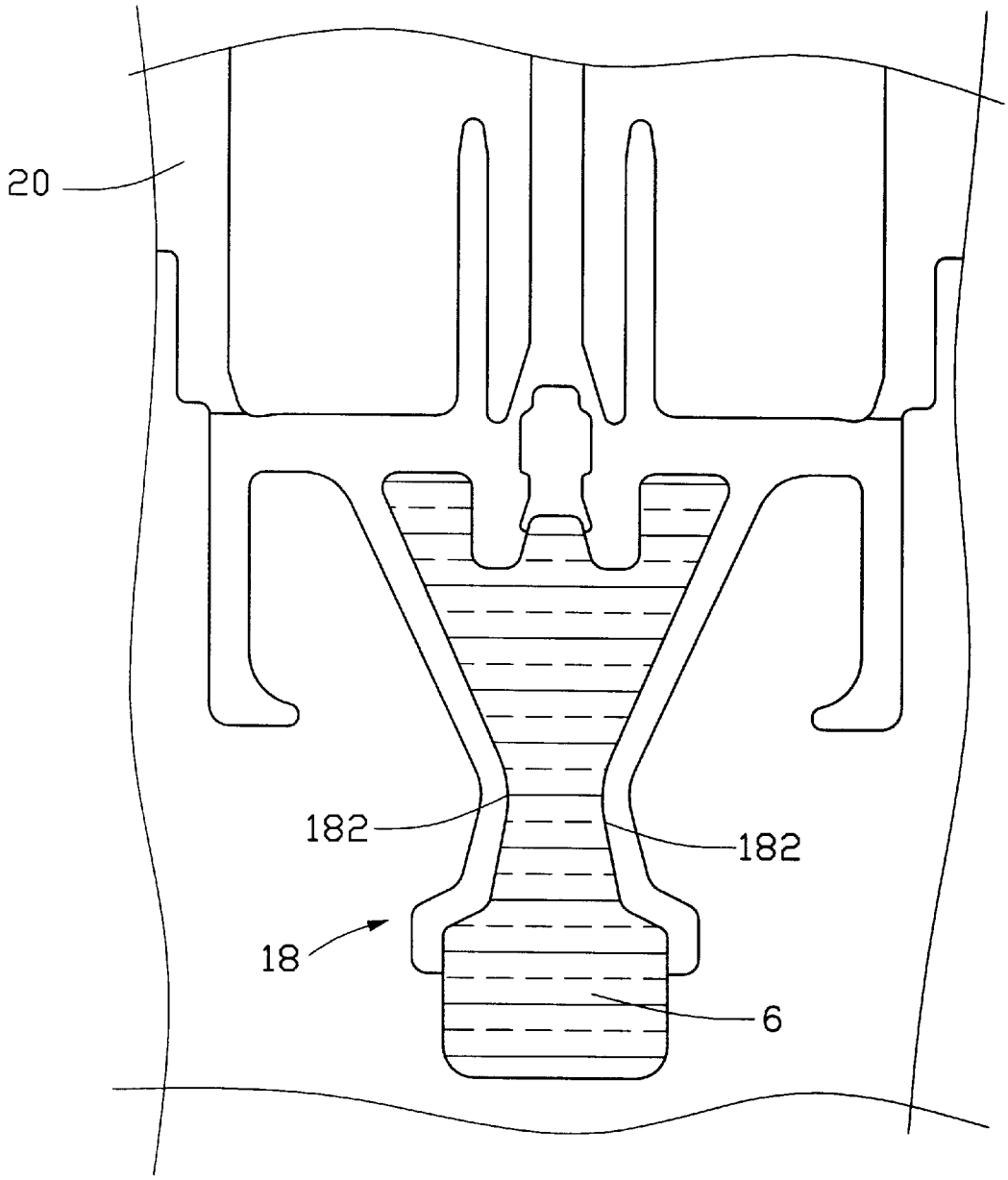
FIG. 3 is a view similar to FIG. 2 showing a first die insert attached to an upper die block is moved to shave the engaging sections of an upper contact.
Figure 4:
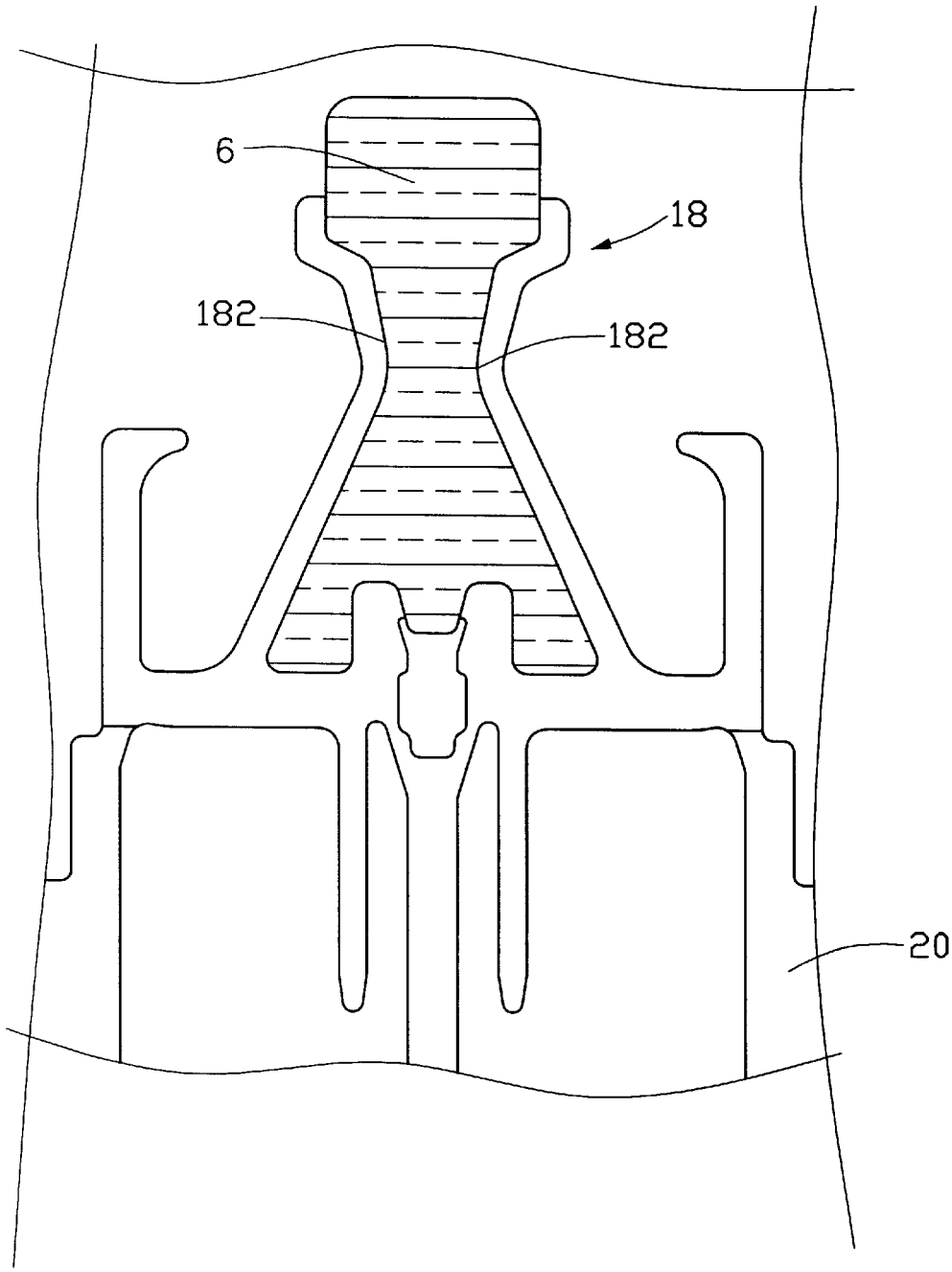
FIG. 4 is a view similar to FIG. 2 showing a second die insert attached to the upper die block is moved to shave the engaging sections of a lower contact.

Referring to FIG. 1, a contact 10 for use in a RIMM connector (not shown) for connecting a Rambus memory module (not shown) to a mother board (not shown) of a computer (not shown) is formed by blanking a metal sheet 20. The contact 10 generally includes a terminal portion 12 for being soldered to the mother board, a fitting portion 14 for having an interference fit with a housing (not shown) of the connector so that the contact 10 can be fixedly received in the connector after the contact 10 is inserted into the housing, a locator 16 used to abutting the housing when the contact has reached its final assembly position with the housing, and a contacting portion 18 for clamping the memory module when the memory module is inserted into the connector. The contacting portion 18 includes two engaging sections 182 (best seen in FIG. 2) facing with each other; each engaging section 182 will be subject to a electrical plating process to be coated with a noble metal layer, for example, a gold layer, thereon after the mechanical forming. Thus, an excellent electrical connection between the engaging sections and corresponding conductive pads of the memory module can be established when the connector and the memory module are connected together.

Figure 5:
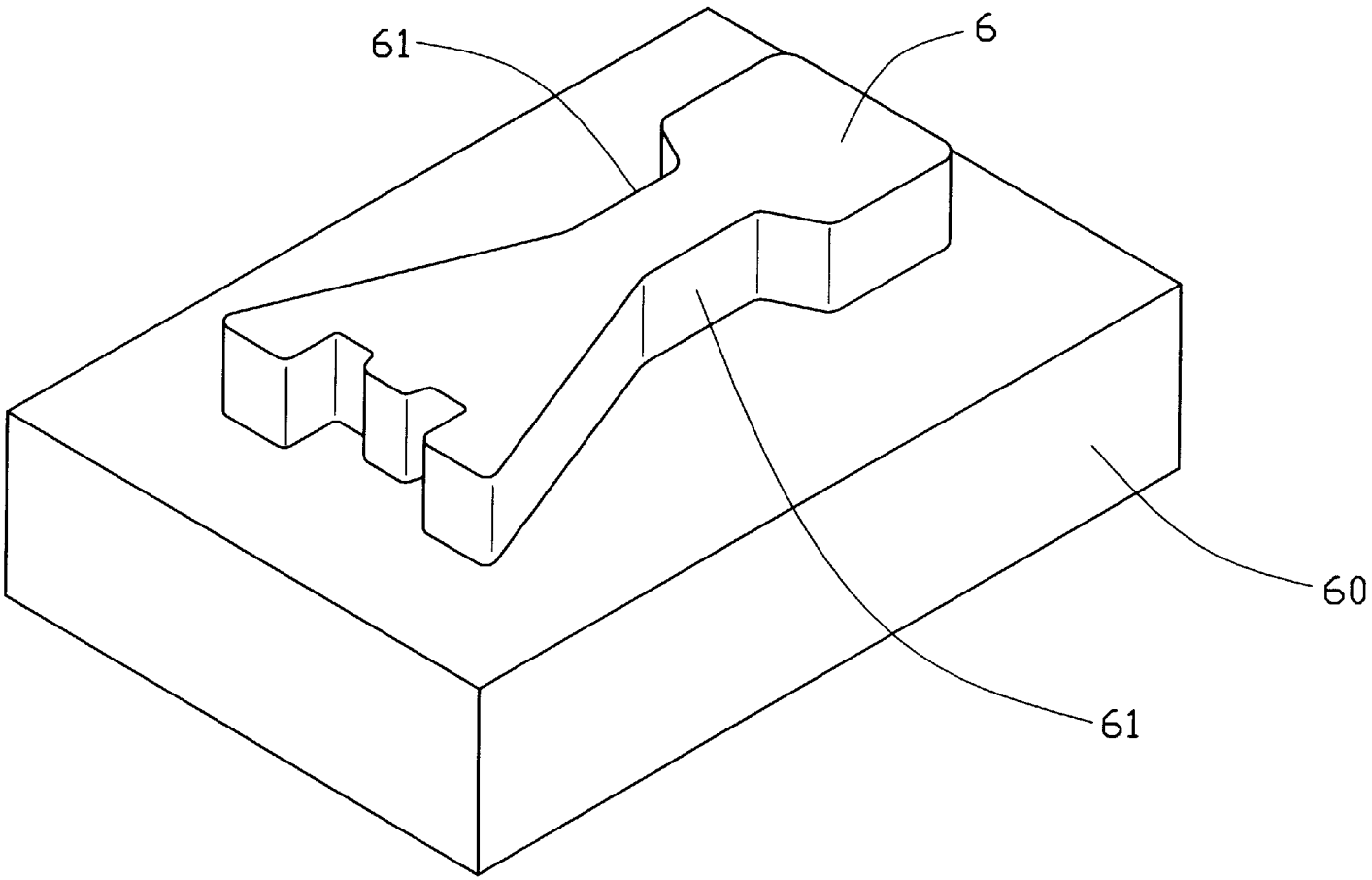
FIG. 5 is an enlarged perspective view of one of the first and second die inserts.

The contact 10 is formed by blanking the metal sheet 20. The blanking is operated in a continuous press machine having a number of working stations. Each working station has a press die consisted of an upper die block and a lower die block. The blanking is practiced generally by the following successive steps in the corresponding working stations:

(1&2) using die blocks 1 and 2 to blank the metal sheet 20 to form a carrier 21 thereon whereby the metal sheet 20 can be subject to a continuous blanking operation in the continuous press machine; the carrier 21 including a number of recesses 211 and holes 212 about side edges 213 of the sheet 20;

(3) using a die block 3 (also referring to FIG. 2) to blank the sheet 20 to generally obtain a profile of each of the engaging sections 182 on the engagement side of the engaging section 182 which is ready to abut agains the module in the connector, wherein a gap 183 is defined between a final profile of each of the engaging sections 182 and a corresponding part of a profile of the die block 3 so that a material is left beside the final profile of a corresponding engaging section 182 (best seen in FIG. 2) for a further shaving process to obtain a desired final surface characteristic and dimension accuracy of the final profile of the corresponding engaging section 182; the gap 183 having a size about 15–30% of a thickness of the metal sheet 20; in the present embodiment, the thickness of the metal sheet 20 being 0.25 mm and the gap being 0.06 mm;

(4) blanking the metal sheet 20 to obtain an outer profile of the contact portion 18, (i.e., the back side of the engaging section 182 which is not engaged with the module in the connector), and an inner profile of the locator 16 by using the die block 4;

(5) blanking the metal sheet 20 to obtain an inner profile of the fit portion 14 by using the die block 5;

(6) blanking the metal sheet 20 by die inserts 6 (also referring to FIGS. 3–5) each being integrally formed with a base 60 fixed to an upper die block, and having a profile with a portion 61 proceeding the shaving process to the material left beside the final profile of the corresponding engaging section 182 so that the engaging section 182 can obtain the required surface characteristic and dimension accuracy; and (7–9) successively blanking metal sheet 20 by die blocks 7–9 to complete the forming of the contacts 10 on the sheet 20.

In accordance with the present invention, in order to let the engaging sections 182, after the shaving operation, to precisely have the finally desired dimension and have an excellent surface smoothness so that they can be evenly and firmly coated with a layer of noble metal thereon by a later electrically plating process, each die insert 6 is subject to the following processing:

After a heat treatment of the die insert 6, it is subject to a profile grinding by a diamond or $B_4C$ grinding wheel having a rotating speed of 3600 r.p.m, a feed of 0.005–0.01 mm, and a moving velocity of 0.6 mm/min alone the profile of the die insert 6. After the profile grinding, an entire length of the profile of the die insert 6 has a surface roughness of 0.12 Ra.

Thereafter, the portion 61 of the profile of the die insert 6 for the shaving operation is further subject to an ultrasonic machining to enable the portion 61 to have a surface roughness of 0.08 Ra.

The ultrasonic machining includes a number of successive steps using the following different grit size diamond particles dispersed in liquid as the working agent: $600^{\#}$, then $1000^{\#}$, $2000^{\#}$, $5000^{\#}$ and finally $8000^{\#}$. The liquid in the present embodiment is water.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

We claim:

1. A method for forming a contact of an electrical connector, comprising the following steps:

a. blanking a metal sheet to form a carrier portion thereon;

b. blanking the metal sheet to form a contact portion of the contact thereon, the contact portion being used for clamping a mating device inserted into the electrical connector, the contact portion having an engaging section for electrically engaging a conductive portion of the mating device to establish an electrical connection between the electrical connector and the mating device;

c. shaving the engaging section by a die insert so that the engaging section can have a smooth surface and precise dimension, the profile of the die insert for shaving the engaging section being subject to a final finishing process by an ultrasonic machining.

2. The method in accordance with claim 1, wherein the profile of the die insert for the shaving operation has a surface roughness of 0.08 Ra after the final finishing process.

3. The method in accordance with claim 1, wherein the ultrasonic machining uses a machining agent consisted of diamond particles dispersed in liquid.

4. The method in accordance with claim 1, wherein the diamond particles have an $8000^{\#}$ grit size.

5. The method in accordance with claim 1, wherein the ultrasonic machining comprises a number of successive steps using the following different grit size diamond particles dispersed in liquid as a working agent: $600^{\#}$, then $1000^{\#}$, $2000^{\#}$, $5000^{\#}$ and finally $8000^{\#}$.

6. The method in accordance with claim 1, wherein before the ultrasonic machining, the profile of the die insert is subject to a profile grinding process by a grinding wheel.

7. The method in accordance with claim 6, wherein the profile grinding is operated under the following condition:

the grinding wheel being a diamond or $B_4C$ grinding wheel having a rotating speed of 3600 r.p.m, a feed of 0.005–0.01 mm, and a moving velocity of 0.6 mm/min alone the profile of the die insert.

8. The method in accordance with claim 7, wherein after the profile grinding, the profile of the die insert has a surface roughness of 0.12 Ra.

9. A method of making a precise dimension and a smooth surface of an engaging section of a contact from a metal sheet, comprising the steps of:

blank the metal sheet by a die block to generally obtain a profile of the engaging section on an engagement side of said engaging section wherein a distance is defined between an outer profile of the die block and a final predetermined profile on said engagement side of the engaging section; and trimming/shaving the engagement side of the engaging section by a die insert, said die insert including a base with a portion projecting above said base with an outer profile configured and dimensioned to comply with said final predetermined profile on the engagement side of the engaging section.

10. The method in accordance with claim 9, wherein said distance is about 15%–30% of a thickness of the metal sheet.

11. The method in accordance with claim 9, wherein said die insert is subject to at least one of procedures of heat treatment, grinding and ultrasonic machining.

* * * * *